US007337789B2

(12) United States Patent
Kupferberg

(10) Patent No.: US 7,337,789 B2
(45) Date of Patent: Mar. 4, 2008

(54) CLEANING APPARATUS FOR EXHAUST SYSTEM AND METHOD

(76) Inventor: Minel Kupferberg, 5862 Ferncroft, Hampstead, Quebec (CA) H3X 1C7

( * ) Notice: Subject to any disclaimer, the term of this patent is extended or adjusted under 35 U.S.C. 154(b) by 743 days.

(21) Appl. No.: 10/898,947

(22) Filed: Jul. 27, 2004

(65) Prior Publication Data

US 2006/0021635 A1 Feb. 2, 2006

(51) Int. Cl.
*B08B 3/027* (2006.01)

(52) U.S. Cl. ..... 134/22.11; 134/22.12; 134/42; 134/166 C; 126/299 E

(58) Field of Classification Search ..... 134/22.1, 134/22.11, 22.12, 42, 166 C, 166 R, 169 R, 134/169 A; 110/171, 215, 306; 454/41, 454/54, 55; 126/299 E
See application file for complete search history.

(56) References Cited

U.S. PATENT DOCUMENTS 1,102,996 A * 7/1914 Bottenstein ..... 261/115
2,653,674 A * 9/1953 Ortgies ..... 422/169
2,937,013 A * 5/1960 Fisher ..... 261/17

* cited by examiner

*Primary Examiner*—Michael Barr
*Assistant Examiner*—Saeed Chaudhry
(74) *Attorney, Agent, or Firm*—Hoffman Wasson & Gitler

(57) ABSTRACT

The present invention provides for a cleaning apparatus for a vertical exhaust pipe in an exhaust system, the cleaning apparatus comprising a cleaning liquid source, an enclosure receiving a cleaning liquid from the cleaning liquid source, and a fluid communication between the enclosure and an inner surface of the exhaust pipe so that the cleaning liquid supplied to the enclosure by the cleaning liquid source is gravity fed into the exhaust pipe through the fluid communication, thereby creating a cleaning liquid film flowing down along at least part of the inner surface of the exhaust pipe, whereby the cleaning liquid film washes the at least part of the inner surface of the exhaust pipe. The cleaning apparatus is thus efficient, has a low risk of failure and is easily accessible for maintenance. A method for cleaning a vertical exhaust pipe in an exhaust system is also provided.

7 Claims, 3 Drawing Sheets

CLEANING APPARATUS FOR EXHAUST SYSTEM AND METHOD

BACKGROUND OF THE INVENTION

1. Field of the Invention

The present invention relates to exhaust systems, and more particularly to cleaning apparatus for the exhaust pipes of such systems.

2. Background Art

Industrial exhaust systems usually include exhaust ducts used to vent gases from an environment. These gases, mostly composed of air, often contain particles which are susceptible to create deposits on the exhaust ducts. Such deposits can interfere with the efficiency of the exhaust system, damage the exhaust ducts if the deposits are corrosive, create a fire risk if the deposits are flammable or an explosion risk if the deposits are unstable. Accordingly, various cleaning apparatus have been set forth to either remove these particles from the exhaust gas or clean the deposits from the exhaust pipes.

U.S. Pat. No. 2,387,345 issued May 14, 1942 to Pearl discloses an apparatus for washing exhaust gas coming out of a stack. This apparatus comprises a cylindrical shell which is installed over the top end of the stack and includes a plurality of nozzles delivering water in various direction to wash the exhaust gas. However, this apparatus does not provide for washing of the interior surface of the stack, where deposits will tend to accumulate.

U.S. Pat. No. 5,860,412 issued Jan. 19, 1999 to Way presents a system for cleaning a kitchen ventilation duct. The system includes a length of piping disposed longitudinally within the duct and possessing a plurality of nozzles regularly spaced apart delivering cleaning fluid on the inner surface of the duct walls. However, such a system would require a large number of nozzles in the case of long ducts, which can be expensive. The length of piping and nozzles can obstruct the exhaust flow moving up the duct. In addition, the plurality of nozzles represent a large number or elements that can potentially fail in the system. Finally, maintenance or replacement of the various elements such as the nozzles can be difficult due to their location inside the duct.

Accordingly, there is a need for an efficient cleaning apparatus for an exhaust system which has a low risk of failure and is easily accessible for maintenance.

SUMMARY OF INVENTION

It is therefore an aim of the present invention to provide an improved cleaning apparatus for a vertical exhaust pipe of an exhaust system.

Therefore, in accordance with the present invention, there is provided a cleaning apparatus for a vertical exhaust pipe in an exhaust system, the cleaning apparatus comprising a cleaning liquid source, an enclosure receiving a cleaning liquid from the cleaning liquid source, and a fluid communication between the enclosure and an inner surface of the exhaust pipe so that the cleaning liquid supplied to the enclosure by the cleaning liquid source is gravity fed into the exhaust pipe through the fluid communication, thereby creating a cleaning liquid film flowing down along at least part of the inner surface of the exhaust pipe, whereby the cleaning liquid film washes the at least part of the inner surface of the exhaust pipe.

Further in accordance with the present invention, there is also provided a method for cleaning a vertical exhaust pipe in an exhaust system, the method comprising the steps of providing an enclosure in fluid communication with the exhaust pipe, the fluid communication being above a portion of an inner surface of the exhaust pipe to be cleaned, supplying a cleaning liquid to the enclosure, allowing the cleaning liquid to be gravity fed from the enclosure through the fluid communication into the exhaust pipe such as to create a cleaning liquid film flowing down along the portion of the inner surface, and removing deposits on the portion of the inner surface through the flowing of the cleaning liquid film.

BRIEF DESCRIPTION OF THE DRAWINGS

Having thus generally described the nature of the invention, reference will now be made to the accompanying drawings, showing by way of illustration a preferred embodiment thereof and in which.

DESCRIPTION OF THE PREFERRED EMBODIMENTS

Figure 1:
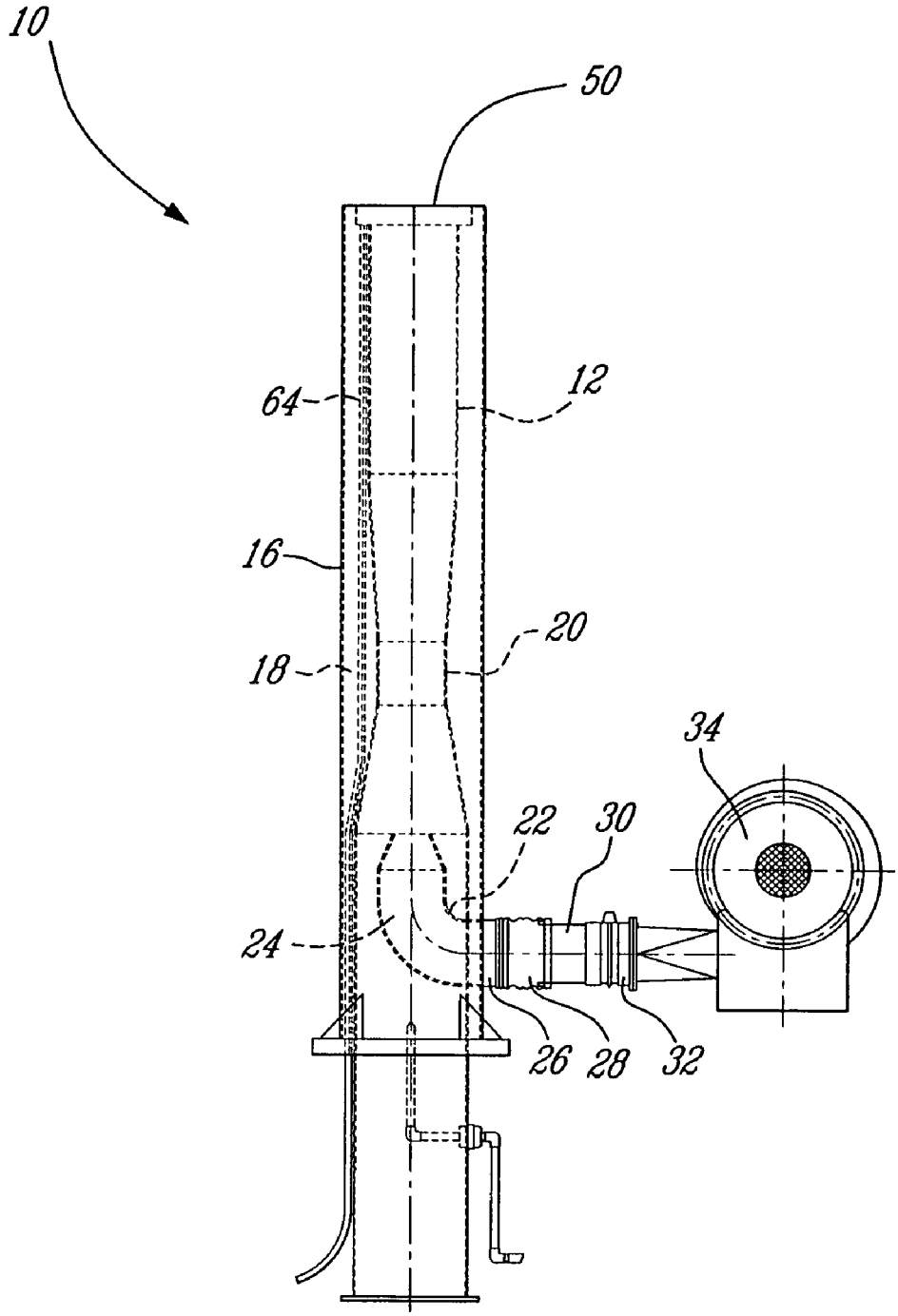
FIG. 1 is a side view of an exhaust system according to a preferred embodiment of the present invention.

Referring now to FIG. 1, an exhaust system, generally indicated at 10, is shown. The exhaust system 10 comprises a vertical exhaust pipe 12 which is connected at a bottom end thereof to a source of exhaust gas (not shown). The exhaust pipe 12 is surrounded by an outer duct 16 so as to create an annular space around the exhaust pipe 12 to receive insulation material 18. The exhaust pipe 12 and outer duct 16 are preferably made of fiber reinforced plastic (FRP) while the insulation material is preferably composed of "R-12" fiberglass.

The exhaust system 10 is similar to that described in U.S. Pat. No. 3,134,345 issued May 26, 1964 to King, which is incorporated herein by reference, and as such will only be briefly explained. A venturi 20, i.e. a constricted section designed to create a pressure drop in a fluid flow, is included in the exhaust pipe 12. A curved pipe 22, comprising a vertical portion 24 connected to an horizontal portion 26, penetrates the exhaust pipe 12 such that the vertical portion is centered in the pipe 12 and aligned with the bottom part of the venturi 20. The horizontal portion 26 is connected to a centrifugal fan 34 through a flexible connector 28, a reducer 30 and a damper 32. In operation, the centrifugal fan 34 provides a flow of air through the curved pipe 22 and up the venturi 20. In the venturi 20, the pressure of the forced air flow drops, creating a vacuum that "pulls" the exhaust gas from the bottom of the exhaust pipe 12.

Figure 2:
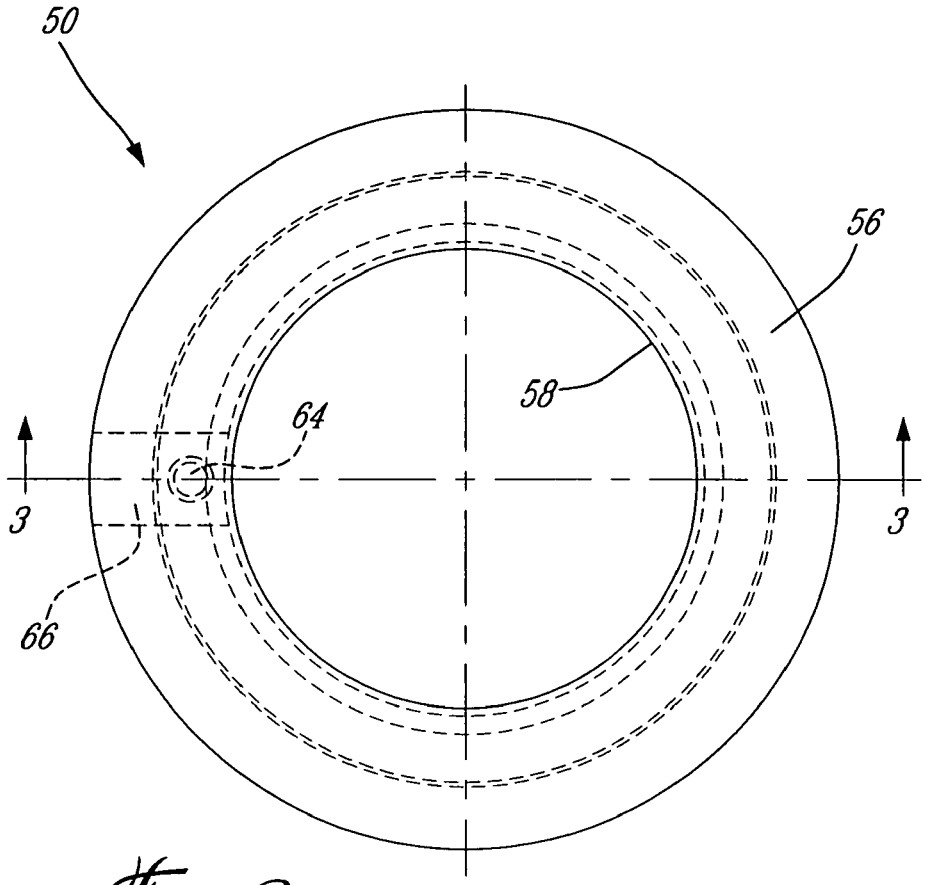
FIG. 2 is a top view of a washing ring in the exhaust system of FIG. 1.
Figure 3:
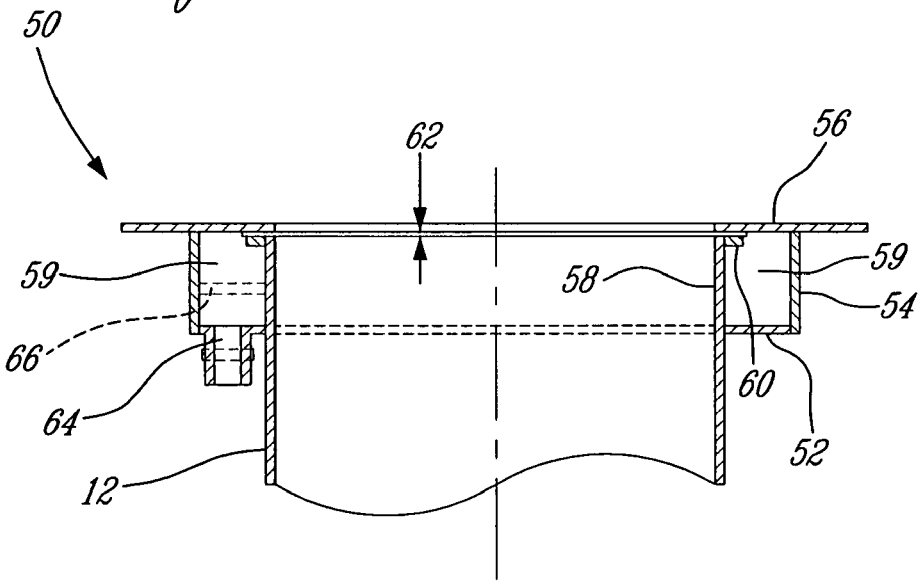
FIG. 3 is a cross-sectional view of the washing ring of FIG. 2 taken along line 3-3.

The exhaust pipe 12 is connected along a top end thereof to a washing ring 50, which is detailed in FIGS. 2-3. Like the exhaust pipe 12, the washing ring 50 is preferably made of FRP. The washing ring 50 comprises an annular enclosure 59 which is defined by a bottom wall 52, an outer wall 54, a top wall 56 and part of a wall 58 of the exhaust pipe 12. The exhaust pipe wall 58 is connected along a top edge thereof to a flange 60 extending inside the enclosure 59. An annular gap between the flange 60 and the top wall 56 of the enclosure 59 creates an annular opening 62 which provides fluid communication between the enclosure 59 and the interior of the exhaust pipe 12. A water pipe 64 (also shown in FIG. 1) is connected to the bottom wall 52 of the enclosure 59. The water pipe 64 is connected to a pressurized water source (not shown), preferably through a three-way valve (not shown) so as to allow emptying of the enclosure 59 and the water pipe 64 when the washing ring 50 is not in use. A deflecting block 66 is provided in the enclosure 59 over the connection of the water pipe 64 to help deflect incoming water around the perimeter of the enclosure 59.

In operation, water from the water source is delivered through the water pipe 64 to the enclosure 59, filling it then overflowing through the annular opening 62. The flow of water is adjusted so that the overflowing water will create a thin film flowing down along the entire perimeter of the inner surface of the exhaust pipe wall 58. This water film will wash away deposits left on the inner surface of the pipe wall 58 by the exhaust gas. The adjustment of the water flow is critical, since a high flow tends to push the water film away from the inner surface of the pipe wall, while a low flow tends to produce an insufficient water film to efficiently wash away the deposits. The water containing the deposits is disposed of at the bottom of the exhaust pipe 12 through any adequate means, such as a reservoir, a drain pipe, etc.

Figure 4:
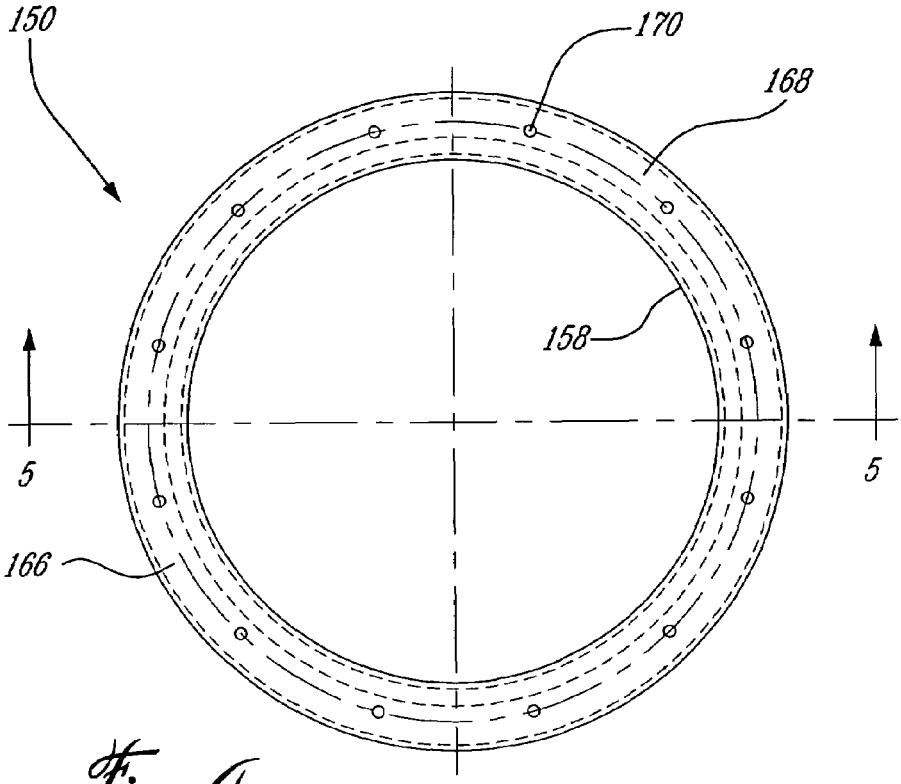
FIG. 4 is a top view of a washing ring for an exhaust system according to another preferred embodiment of the present invention.
Figure 5:
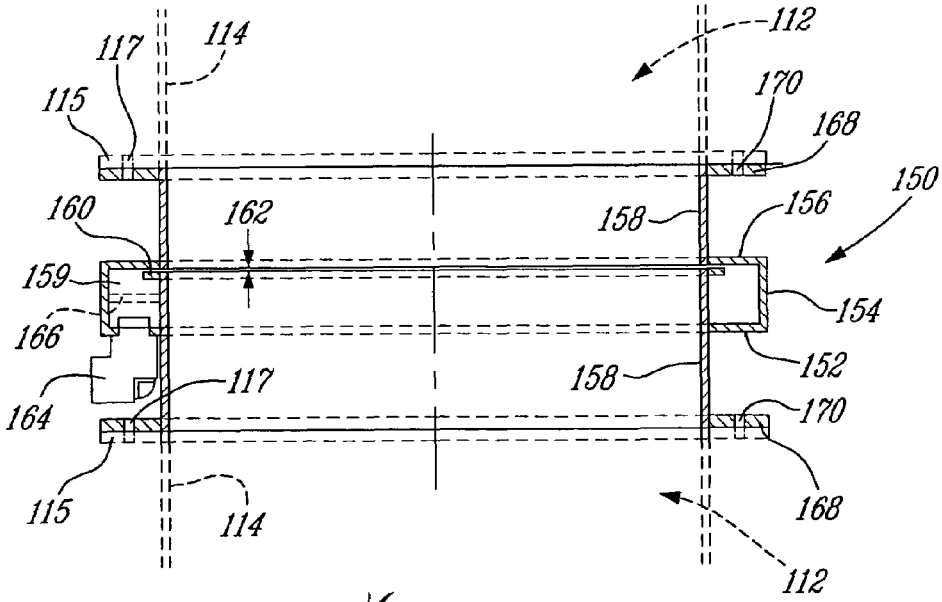
FIG. 5 is a cross-sectional view of the washing ring of FIG. 4 taken along line 5-5.

In the case of tall exhaust pipes, the water film can become saturated in deposits before reaching the bottom of the pipe and thus losses its cleaning efficiency. Additional washing rings 150, such as shown in FIGS. 4-5, can be regularly disposed along the height of the pipe 112 such as to provide a fresh water film, for example one every ten (10) feet. In this embodiment, the washing ring 150 is used to connect exhaust pipe sections 114 forming the tall exhaust pipe 112 (in broken lines in the figures).

The washing ring 150 comprises an annular enclosure 159 which is defined by a bottom wall 152, an outer wall 154, a top wall 156 and an inner wall 158. The inner wall 158, aligned with the walls of the exhaust pipe sections 114, also acts as an exhaust pipe wall within the height of the ring 150. The inner wall 158 includes an annular opening 162, preferably located just below the top wall 156 of the enclosure 159. As in the previous embodiment, the bottom of the annular opening 162 is preferably bordered by a flange 160 extending in the enclosure and connected to the inner wall 158. A water pipe 164 is connected to the bottom wall 152 of the enclosure 159 and to a pressurized water source, preferably through a three-way valve. A deflecting block 166 is provided in the enclosure 159 over the connection of the water pipe 164 to help deflect incoming water around the perimeter of the enclosure 159.

The inner wall 158 ends by an annular connecting flange 168 both at the bottom and top end of the washing ring 150. Both connecting flanges include regularly angularly spaced apart bolt holes 170. The exhaust pipe sections 114 also each include a connecting flange 115 with similar bolt holes 117. Each exhaust pipe section 114 is connected to the washing ring by attaching the connecting flanges 115,168 together with a series of bolts (not shown) through the bolt holes 117,170.

As in the previous embodiment, water from the water source is delivered through the water pipe 164 to the enclosure 159 and overflows through the annular opening 162, creating a thin film flowing down along the entire perimeter of the inner surface of the inner wall 158 and continuing along the inner surface of the wall of the pipe section 114 under the ring 150. The water film washes the deposits on the inner surface of the pipe wall.

Although the washing rings 50,150 have been described as using water to clean the exhaust pipe 12, another appropriate cleaning solvent could also be used together with or instead of water. Also, the washing rings 50,150 can be used with other types of exhaust pipes not including a venturi system.

The embodiments of the invention described above are intended to be exemplary. Those skilled in the art will therefore appreciate that the forgoing description is illustrative only, and that various alternatives and modifications can be devised without departing from the spirit of the present invention. Accordingly, the present is intended to embrace all such alternatives, modifications and variances which fall within the scope of the appended claims.

I claim:

1. A cleaning apparatus for a vertical exhaust pipe in an exhaust system, the cleaning apparatus comprising:

a cleaning liquid source;

an enclosure receiving a cleaning liquid from the cleaning liquid source; and a fluid communication between the enclosure and an inner surface of the exhaust pipe so that the cleaning liquid supplied to the enclosure by the cleaning liquid source is gravity fed into the exhaust pipe through the fluid communication, thereby creating a cleaning liquid film flowing down along at least part of the inner surface of the exhaust pipe;

whereby the cleaning liquid film washes the at least part of the inner surface of the exhaust pipe wherein the enclosure extends around an entire perimeter of the exhaust pipe, a portion of the exhaust pipe forming an inner wall of the enclosure.

2. The cleaning apparatus according to claim 1, wherein the exhaust pipe is cylindrical, and the enclosure is annular and defined by the portion of the exhaust pipe, an annular bottom wall, a cylindrical outer wall concentric with the exhaust pipe, and an annular top wall.

3. The cleaning apparatus according to claim 1, wherein the portion of the exhaust pipe includes a top edge of the exhaust pipe, a gap between the top edge and a top of the enclosure providing the fluid communication between the enclosure and the exhaust pipe inner surface.

4. The cleaning apparatus according to claim 1, wherein the fluid communication between the enclosure and the exhaust pipe inner surface is provided by an opening defined through the perimeter of the portion of the exhaust pipe.

5. The cleaning apparatus according to claim 1, wherein the cleaning liquid is water.

6. The cleaning apparatus according to claim 1, wherein the cleaning liquid is selected from one or more of a cleaning solvent and water.

7. A method for cleaning a vertical exhaust pipe in an exhaust system, the method comprising the steps of:

providing an enclosure in fluid communication with the exhaust pipe, the fluid communication being above a portion of an inner surface of the exhaust pipe to be cleaned;

supplying a cleaning liquid to the enclosure;

allowing the cleaning liquid to be gravity fed from the enclosure through the fluid communication into the exhaust pipe such as to create a cleaning liquid film flowing down along the portion of the inner surface; and removing deposits on the portion of the inner surface through the flowing of the cleaning liquid film wherein the enclosure extends around an entire perimeter of the exhaust pipe, a portion of the exhaust pipe forming an inner wall of the enclosure.

* * * * *